United States Patent [19]

Gansser

[11] Patent Number: 4,753,755

[45] Date of Patent: Jun. 28, 1988

[54] SOLID ALKALINE DETERGENT AND PROCESS FOR MAKING THE SAME

[75] Inventor: Robert E. Gansser, Riverview, Mich.

[73] Assignee: Diversey Wyandotte Corporation, Wyandotte, Mich.

[21] Appl. No.: 900,143

[22] Filed: Aug. 25, 1986

[51] Int. Cl.[4] ..... C11D 7/06; C11D 7/32; C11D 11/00; C11D 17/00

[52] U.S. Cl. ..... 252/527; 252/89.1; 252/90; 252/135; 252/156; 252/174; 252/174.16; 252/174.21; 252/174.24; 252/546; 252/DIG. 1; 252/DIG. 10; 252/DIG. 11

[58] Field of Search ..... 252/99, 134, 135, 156, 252/174, 174.14, 174.16, 174.24, 527, 546, DIG. 11, 89.1, 90, 174.21

[56] References Cited

U.S. PATENT DOCUMENTS

| | | | |
|---|---|---|---|
| 2,987,483 | 6/1961 | Brooker | 252/539 |
| 3,491,029 | 1/1970 | Kasperl | 252/156 |
| 3,627,686 | 12/1971 | Sabatelli | 252/527 |
| 3,649,545 | 3/1972 | Susuki | 252/174 |
| 3,669,893 | 6/1972 | Clarke | 252/156 |
| 3,673,098 | 6/1972 | Sabatelli | 252/156 |
| 3,705,856 | 12/1972 | Sedliar | 252/156 |
| 3,870,560 | 3/1975 | Shumaker | 134/2 |
| 4,105,573 | 8/1978 | Jacobsen | 252/99 |
| 4,147,650 | 4/1979 | Sabatelli | 252/103 |
| 4,545,917 | 10/1985 | Smith | 252/90 |
| 4,560,493 | 12/1985 | Scharf | 252/174.16 |
| 4,569,780 | 2/1986 | Fernholz et al. | 252/90 |
| 4,569,781 | 2/1986 | Fernholz et al. | 252/92 |
| 4,595,520 | 6/1986 | Heile et al. | 252/160 |

FOREIGN PATENT DOCUMENTS

| | | | |
|---|---|---|---|
| 1802921 | 4/1970 | Fed. Rep. of Germany | 252/156 |
| 1461297 | 8/1969 | France | 252/156 |

*Primary Examiner*—Dennis Albrecht
*Attorney, Agent, or Firm*—Arnold S. Weintraub

[57] ABSTRACT

A method for producing a solid alkaline detergent in which an effective amount of a hardness sequestering agent is mixed in an aqueous solution containing less than about 51 percent of an alkali metal hydroxide or an alkali metal silicate at a temperature between about 55° F. and about 130° F. to form a liquid dispersion. A solid caustic material is then added to the liquid dispersion in sufficient quantity to cause the eventual solidification of the dispersion. The dispensed is then mixed until homogeneous and can then be dispersion into a suitable receptacle and permitted to solidfy.

14 Claims, No Drawings

SOLID ALKALINE DETERGENT AND PROCESS FOR MAKING THE SAME

BACKGROUND OF THE INVENTION

1. Field of the Invention

This invention relates to a process for making solid alkaline detergents at low temperatures and a method for preparing detergents containing nitrilotriacetate.

2. Description of the Prior Art

In conventional institutional and industrial spray washing machines, detergents are added to the wash tank by means of automatic dispenser systems. These detergents generally have high levels of alkalinity. Accordingly, they contain alkali metal hydroxides such as sodium hydroxide as well as chemicals which are particularly useful for hard surface cleaning. Examples of these have included phosphates, silicates, chlorine-containing compounds, defoamers and organic polyelectrolyte polymers and the like.

One major problem with automatic dish washing detergents is the inability of these detergents to be easily measured and dispensed. Solid or cast detergents provide a means whereby the safety, convenience and performance of the detergent and cleaning system can be enhanced. The use of solid cast detergents minimizes contact between the user and the high performance or high alkalinity detergent composition. Additionally, such cast detergents provide ease in insertion and replacement.

One problem found in both solid cast detergent compositions and powder detergent compositions is caused by the differing solubilities of the various components in water. Because the components of standard detergents dissolve at differing rates or have different equilibrium solubilities, the first effluent from a solid cast detergent may be overly rich in certain compounds while lacking other key detergent compounds causing the effectiveness of the detergent to vary greatly through the wash cycle or from washing to washing.

Another problem encountered in the manufacture and use of solid, cast detergents is the instability of certain detergent components at high temperatures or under highly alkaline conditions. Generally, in order to form a homogeneous, cast alkaline detergent, an aqueous solution of a caustic material such as sodium hydroxide is melted at temperatures above the "freeze" point for the given solution. For sodium hydroxide solutions of about 65 to about 75 percent, this temperature is above 144° to 146° F. Other desired detergent components can be added to the melted caustic solution and mixed to assure uniform dispersion. The melted solution can, then, be poured into the desired molds. As the caustic solution cools, it solidifies forming the solid cast detergent.

Various sequestrants have been incorporated in the caustic melts with varying degrees of success. One such sequestrant, sodium tripolyphosphate, is extremely effective but difficult to incorporate in solid cast detergent. Sodium tripolyphosphate exhibits instability at high temperatures in alkaline media and is known to revert to sodium tetrapyrophosphate and sodium orthophosphate under such conditions. These reversion products have less sequestering ability than that of sodium tripolyphosphate.

Methods of manufacturing cast detergents which overcome this reversion problem have been proposed. U.S. Pat. No. 4,569,780 to Fernholz et al outlines a method for making solid cast detergent in which an alkali metal hydroxide is heated to a temperature above its melt point. Alkaline hydratable compounds such as sodium tripolyphosphate present in an alkaline solution can then be added to the melt. In order to work, the sodium hydroxide must be heated. This procedure is expensive and requires excessive quantities of external heat.

Similarly, U.S. Pat. No. 4,147,650 to Sabatelli and Daugherty teaches a method for making an alkaline detergent slurry using sodium hydroxide and/or sodium metasilicate, sodium tripolyphosphate and water. The amount of caustic is strictly monitored. Amounts greater than 40 to 50 percent by weight sodium hydroxide are avoided as causing solidification to occur.

Thus, it would be desirable to provide a method for making a solid, cast alkaline detergent which incorporates sequestering agents homogeneously therein. It is also desirable that the process require temperatures below 144° to 146° F. It is also desirable that the process employ a sequestering agent having an effectiveness similar to sodium tripolyphosphate. It is desirable that the sequestrant employed have solubility properties compatible with those of the other detergent components.

SUMMARY OF THE INVENTION

The present invention is predicated on the discovery that, under the conditions outlined below, hardness sequestering agents selected from the group consisting of alkali salts of nitrilotriacetic acid, phosphonic acid, gluconic acid, ethylene diamine tetraacetic acid or mixtures thereof, function as a suitable substitute for sodium tripolyphosphate in solid, cast detergents. Additionally, it has been found that a solid cast detergent can be produced without the addition of large amounts of heat from external sources as was necessary in the past by using the method of the present invention.

The present invention is a method for making a solid detergent comprising the steps of:

(a) mixing an effective amount of a hardness sequestering agent into an aqueous solution containing less than about 51 percent by weight of an alkaline material selected from the group consisting of alkali metal hydroxides, alkali metal silicates and mixtures thereof at a temperature between ambient temperature (about 50° F.) and about 130° F. to form a liquid dispersion;

(b) adding an amount of a solid caustic material sufficient to cause eventual solidification of the liquid dispersion;

(c) mixing the resultant liquid dispersion until homogeneous;

(d) dispensing the mixed liquid dispersion to a suitable receptacle; and (e) allowing the dispensed liquid dispersion to solidify.

Other optional detergent ingredients can be incorporated into the alkaline solution. These include nonionic surfactants and polymeric polyelectrolytes.

DESCRIPTION OF THE PREFERRED EMBODIMENT

In accordance with the present invention, there is provided a method for making a solid, alkaline detergent. The method preferably used to produce solid, cast detergent articles, without requiring external heat input, comprises the steps of:

(a) mixing an effective amount of a hardness sequestering agent into an aqueous solution containing less than about 51 percent by weight of an alkaline material selected from the group consisting of alkali metal hydroxides, alkali metal silicates or mixtures thereof at a temperature between ambient temperature (about 50° F.) and about 130° F. to form a liquid dispersion;

(b) adding an amount of solid caustic material sufficient to cause eventual solidification of the liquid dispersion;

(c) mixing the resultant liquid dispersion until homogeneous;

(d) dispensing the mixed resulting liquid dispersion to a suitable receptacle; and (e) allowing the dispensed liquid dispersion to solidify.

In the preferred embodiment, an aqueous solution contains between about 34 percent and about 50 percent by weight of an alkaline material and is maintained at ambient temperature (between about 50° F. and about 75° F.) until addition of the sequestering agent. The alkaline material is selected from the group consisting of alkali metal hydroxides, alkali metal silicates and mixtures thereof. In general, alkali metal hydroxides are employed in the present invention, with sodium hydroxide being preferred.

The hardness sequestering agent employed in the present invention is a compound capable of sequestering hardness caused by the presence in the water of ions such as magnesium ($Mg^{2+}$), calcium ($Ca^{2+}$) and the like. In the present invention, the sequestering agents chosen are alkali metal salts of phosphonic acid, alkali metal salts of gluconic acid, alkali metal salts of ethylene diamine tetraacetic acid, alkali metal salts of nitrilotriacetic acid and mixtures thereof. Alkali metal salts of nitrilotriacetate such as sodium nitrilotriacetate and the like are preferred as it has been discovered that alkali metal salts of nitrilotriacetate exhibit superior sequestering ability when incorporated in a solid cast detergent manufactured by the method of the present invention. However, it is to be understood that the method of the present invention permits effective integration of any of the enumerated sequestrants while minimizing the potential for the chosen sequestrant to revert to undesirable or non-useful forms.

In the method of the present invention, the sequestrant is added to the alkaline mixture and mixed until a homogeneous dispersion is produced. In general, the addition occurs at or near ambient temperature. If the viscosity of the alkaline mixture and sequestrant is too high to permit easy stirring with standard mixing equipment, the alkaline mixture may be warmed to a temperature between about 100° F. and 130° F. before the addition of the sequestrant. It has been found that temperatures above about 100° F. result in substantial reductions in viscosity.

The amount of sequestrant added is between about ½ part to about 2 parts by weight sequestrant to about one part alkaline solution. The amount of sequestrant added provides a solid cast detergent having between about 33 percent and about 44 percent by weight sequestrant based on the total weight of the finished detergent.

Various other detergent components may also be added to the aqueous alkaline solution along with the sequestrant. Among these components are nonionic surfactants. It has been found that nonionic surfactants present in alkaline solutions act as a defoamer for food oils, help the caustic to wet and penetrate soil and assist in final rinsing of the caustic.

The nonionic surfactant used herein is selected from the group consisting of alcohol alkoxylates, alkyl aryl alkoxylates, block copolymers and mixtures thereof. Generally, these nonionic surfactants are prepared by the condensation reaction of a suitable amount of ethylene oxide and/or propylene oxide with a selected organic hydrophobic base under suitable oxyalkylation conditions. These reactions are well known and documented in the prior art.

A useful class of surfactants are the alkylene oxide adducts of hydrophobic bases which correspond to the formula:

$$Y[C_3H_6O)_a(C_2H_4O)_bH]_x$$

wherein Y is the residue of an organic compound containing from two to six carbon atoms and having x reactive hydrogens, x being at least two, a has a value such that the molecular weight of the polyoxypropylene base is at least about 900 and not in excess of about 4000, and b has a value such that the oxyethylene content of the molecule is from about 10 to about 50 percent by weight. Compounds defined by Y include, for example, propylene glycol, glycerine, pentaerythritol, trimethylolpropane, ethylene diamine, triethanolamine, triisopropanolamine, butylamine and the like. These surfactants are more particularly described in U.S. Pat. Nos. 2,674,619 and 2,979,528.

Preferred within this group of conjugated compounds are those which correspond to the formula:

$$H(C_2H_4O)_b(C_3H_6O)_a(C_2H_4O)_bOH$$

wherein a and b have the values described above and Y is propylene glycol, and which are more particularly defined in the above-referred to U.S. Pat. No. 2,674,519.

Another useful class of nonionic surfactants are polyoxyalkylene compounds having heteric polyoxyethylene chains, and which are represented structurally as $$Y(—P—E—H)_x$$

wherein Y is the residue of an organic compound having x reactive hydrogens and up to six carbon atoms, P is a hydrophobic polyoxyalkylene chain having an oxygen/carbon atom ratio of not more than 0.40, the molecular weight of P and the value of x being such that the molecule, excluding E, has a molecular weight of at least about 400 to 900 and up to about 25,000, and E is a hydrophilic polyoxyalkylene chain which (1) contains oxyethylene groups and at least 5 percent by weight of higher molecular weight oxyalkylene groups having at least three carbon atoms in their structure, and (2) has an average oxygen/carbon atom ratio of greater than 0.40, E being present in the composition in an amount sufficient to constitute from about 5 to 90 percent by weight of the total composition. These surfactants are more particularly described in U.S. Pat. No. 3,101,374.

Still another useful class of liquid nonionic surfactants are the alkoxylates of linear aliphatic alcohols. These surfactants can be generally designated as:

$$R—O(A)_nH$$

wherein R is the organic residue of a linear aliphatic alcohol or mixtures thereof having from eight to 20 carbon atoms in the aliphatic portion, A represents oxyalkylene groups, and n is an integer such that the oxyalkylene groups constitute from 55 percent to 80 percent by weight of the compound. Generally, A represents oxyethylene groups, oxypropylene groups or mixtures thereof. These surfactants are generally prepared either by using a random mixture of oxyalkylene groups or in sequential addition thereof. When both oxyethylene groups and oxypropylene groups are employed they are present in a respective weight ratio of from about 1:2 to 7:1. These surfactants are more particularly described in U.S. Pat. Nos. 3,340,309, and 3,504,041 and Canada Pat. No. 770,664.

Other useful surfactants include the propylene oxide adducts of polyoxyethylene glycol such as described in U.S. Pat. No. 3,036,118.

Suitable surfactants include those marketed by BASF Wyandotte Corporation under the trade names PLURONIC, TETRONIC, PLURAFAC, PLURADOT and INDUSTROL.

The nonionic surfactant is preferably employed in amounts up to about 5 percent by weight based on the total weight of the solid detergent produced. In the preferred embodiment, sufficient surfactant is employed to yield a finished detergent containing between about 1.0 and about 4.0 percent by weight surfactant. In general, this is an amount that can be achieved by adding between about 0.025 and about 0.10 parts by weight surfactant to one part alkaline solution.

Polymeric compounds may also be added to the aqueous solution as anti-spotting or anti-redeposition agents and to reduce the tendency for scale formation in dishwashing machinery. The polymeric compounds may be added in sufficient amounts to provide a solid detergent having up to about 5.0 percent by weight polymer. This percentage can be achieved by adding less than 0.125 part polymeric compound per one part alkaline solution. In the preferred embodiment, sufficient quantities of polymer are added to provide a solid detergent having between about 1.0 and about 2.0 percent by weight polymer. The polymer employed is an alkali metal salt of a polyacrylic acid or various copolymers such as those formed from the reaction of various olefins such as ethylene, methyl vinyl ether, styrene, etc. with acrylic acid, maleic acid or maleic anhydride. Other polymers which can be suitably used include copolymers formed from the reaction of maleic acid or maleic anhydride with acrylic acid. Examples of polymers which can be successfully employed in this invention include methyl vinyl ether/maleic anhydride copolymers available from the GAF Corporation under the trade name GANTREZ; ethylene/maleic anhydride copolymers available from Monsanto Corporation under the trade name EMA; styrene/maleic anhydride copolymers available from ARCO under the trade name SMA and maleic acid/acrylic acid copolymers available from BASF Corporation under the trade name SOKALAN. In the preferred embodiment, a sodium polyacrylate polymer is employed. Such polymers are commercially available from Rohm and Haas Company under the trade name ACRYSOL.

Once the added components are thoroughly mixed, sufficient solid caustic material is added to the dispersion to cause eventual solidification. Between about 15.0 and about 28.0 percent by weight solid caustic is, preferably, added to the alkaline solution. The caustic is selected from the group consisting of alkali metal silicates, alkali metal hydroxides and mixtures thereof. In the preferred embodiment, pelletized or flaked anhydrous alkali metal hydroxide such as sodium hydroxide is added and mixed with the alkaline solution.

The alkaline dispersion may be maintained at a temperature between ambient and about 130° F. while the solid caustic is added. The alkaline dispersion can be mixed during addition of the solid caustic. Mixing can continue after caustic addition for a period from about 2 minutes to a period of 2 to 3 hours or more.

It is to be understood that the addition of the solid caustic material to the aqueous alkaline dispersion can be exothermic. The caustic addition can trigger an increase in the dispersion temperature. The viscosity of the dispersion is noticably reduced at temperatures above about 100° F. The exothermic reaction as the solid caustic is added to the dispersion can be used advantageously to permit proper liquidity of the dispersion. As the temperature of the dispersion decreases after addition of the solid caustic material, the dispersion will become more viscous and eventually solidify.

At processing temperatures between about 100° F. and about 130° F., the viscosity increases with time. To ensure that the final mixture does not remain in the mixing vessel for too long and become too viscous to dispense into molds, a portion of the alkaline dispersion can be run in from a large mixing tank into smaller mixing tanks prior to addition of the caustic. After mixing, the dispersion can be dispensed into molds where the dispersion is permitted to solidify.

The present invention is further understood by reference to the following examples which are illustrative of the method of producing alkaline solid detergent of this invention. It is to be understood that these examples are illustrative and are not to be construed as limitative of the invention described therein.

EXAMPLE I

A solid cast detergent is prepared according to the method of the present invention. One hundred and ninety-eight grams of a 50 percent sodium hydroxide solution was placed in a 500 ml stainless steel beaker. Six grams of sodium polyacrylate and 10 grams of nonionic surfactant were added to the solution and mixed. The resulting mixture was stirred using a Heller HST 20 stirrer with rpm and torque readouts at 500 rpm. The material was stirred with a pair of two-inch diameter, three-bladed props, spaced about one and one-half inches apart. Viscosity of the solution was measured as increases in torque. The temperature of the solution was measured throughout mixing and subsequent additions.

One hundred and sixty-five grams of sodium nitrilotriacetate were added to the sodium hydroxide solution having an initial temperature of 71° F. The composition is designated Composition A. The solution temperature increased from 71° F. to 73° F. and the torque increased from less than 0.1 to 6.0 ounce-inches.

One hundred and twenty-one grams of anhydrous sodium hydroxide pellets were added to the dispersion over a period of two minutes with continual mixing. The stirring torque increased from about 6.0 oz-in to 11.7 oz-in during the course of caustic addition. The mixing torque continued to rise to about 15.2 oz-in over the next two minutes following caustic addition, then slowly decreased with mixing time to about 7.2 oz-in after one hour, 6.5 oz-in after two hours and 6.2 oz-in after about three hours of mixing. Temperature elevation resulted in a viscosity reduction measured as a spindle torque of 1.5 oz-in. At any time after the initial two minutes of mixing subsequent to caustic addition the dispersion was in a condition suitable for dispensing into appropriate molds. The data pertaining torque and dispersion temperature is found in Table I and is graphically illustrated in the graph of FIG. 1.

TABLE I

TORQUE AND TEMPERATURE DATA FOR COMPOSITION A

| Elapsed Time (min.) | Torque (oz-in) | Composition Temperature (°F.) |
|---|---|---|
| –[1] | 0 | 71 |
| –[2] | 6.0 | 73 |
| 0[3] | 11.7 | 75 |
| 1 | 14.5 | 75 |
| 2 | 15.2 | 76 |
| 3 | 14.5 | 77 |
| 4 | 14.1 | 77 |
| 5 | 13.5 | 78 |
| 10 | 11.9 | 80 |
| 15 | 10.6 | 82.5 |
| 20 | 10.15 | 84 |
| 30 | 9.15 | 86.5 |
| 40 | 8.55 | 88 |
| 50 | 7.9 | 89.5 |
| 60 | 7.25 | 90.5 |
| 80 | 6.25 | 92 |
| 94 | 6.25 | 92 |
| 113 | 6.5 | 92 |
| 130 | 6.5 | 91.5 |
| 160 | 6.45 | 91.5 |
| 180 | 6.2 | 91.5 |

[1]50 percent NaOH solution containing no beads or NTA.
[2]Nitrilotriacetate (NTA) addition.
[3]Addition of anhydrous caustic over a two-minute interval. Data taken at end of caustic addition.

EXAMPLE II

A solid cast detergent was prepared according to the method of the present invention. One hundred and sixty-five grams of nitrilotriacetate were admixed with one hundred and ninety-eight grams of 50 percent NaOH solution. The resulting dispersion was mixed for about 15 minutes using the stirrer described in Example II rotating at 700 rpm. The torque and dispersion temperature were measured at intervals. The results are summarized in Table IIA.

After 15 minutes of mixing, 121 grams of anhydrous sodium hydroxide was added to the dispersion over a two minute interval. Mixing was continued and the torque and dispersion temperature were monitored. The results are summarized in Table IIB.

Thirty minutes after the anhydrous caustic pellets were added, the dispersion was poured into two 4 oz clear plastic bottles. The material poured easily. The temperature was monitored for the next two hours. At the end of two hours the material gelled and had a temperature of 79° F. One of the bottles was inverted and little movement of the mass was observed. The material was homogeneous with good crystal formation throughout.

TABLE II

A. Torque and Temperature Data of 50 Percent Caustic/Nitrilotriacetate Dispersion.

| Time (minutes) | Torque[1] (oz-in) | Temperature (°F.) |
|---|---|---|
| 0 | 4.5 | 79 |
| 12 | 3.6 | 80.5 |
| 15 | 3.6 | 82 |
| 17 | 3.5 | 82.5 |

B. Torque and Temperature Data of 50 Percent Caustic/Nitrilotriacetate Dispersion After Addition of NaOH Pellets TABLE II-continued

| Time (minutes) | Torque[1] (oz-in) | Temperature (°F.) |
|---|---|---|
| 0 | — | — |
| 1 | 11.55 | 83 |
| 3 | 10.3 | 84 |
| 6 | 9.4 | 86 |
| 9 | 9.0 | 87 |
| 10 | 8.8 | 88 |
| 15 | 8.3 | 90.5 |
| 22 | 7.8 | 93 |
| 30 | 7.6 | 95 |

EXAMPLE III

The procedure outlined in Example I was followed except that after addition of sodium polyacrylate and nonionic surfactant to the solution, the temperature was adjusted to 120° F.

Addition of 165 grams of sodium nitrilotriacetate caused the torque to increase from less than 0.1 oz-in to 1.6 oz-in. While the temperature was maintained at 120° F., 121 grams of anhydrous sodium hydroxide pellets were added to the mixture with continuous stirring. The stirring torque rose from 1.6 to 2.5 oz-in following caustic addition. The temperature remained constant after caustic addition with no additional input of heat. Subsequently, the torque rose at a rate of about 1.0 oz-in for every ten minutes of stirring. Thus, 10 minutes after addition of the caustic pellets, the stirring torque was 3.5 oz-in; after 20 minutes, 4.5 oz-in and after 30 minutes, 5.5 oz-in. The product may be dispensed into suitable molds any time after about two minutes following the addition of the caustic pellets.

Having thus disclosed the present invention, what is claimed is:

1. A process for producing a solid detergent comprising the steps of:

(a) mixing an effective amount of an alkali metal salt nitrilotriacetic acid as a hardness sequestering agent into an aqueous solution containing less than about 51 percent, by weight, of an alkaline material selected from the group consisting of alkali metal hydroxides, alkali metal silicates and mixtures thereof at a solution temperature between about 50° F. and about 120° F. to form a liquid dispersion;

(b) adding an amount of the same alkaline material in solid form to the dispersion sufficient to cause eventual solidification of the dispersion;

(c) mixing the resulting liquid dispersion until homogeneous;

(d) dispensing the mixed liquid dispersion into a suitable receptacle; and (e) allowing the dispensed liquid dispersion to solidify.

2. The process of claim 1 wherein between about 0.5 part to about 2 parts by weight hardness sequestering agent are added to about 1 part of the aqueous alkaline solution.

3. The process of claim 1 wherein the hardness sequestering agent is added in an amount between about 33 percent and about 44 percent by weight of the resulting solid cast detergent.

4. The process of claim 1 wherein the alkaline material is sodium hydroxide.

5. The process of claim 1 wherein between about 15 percent and about 28 percent by weight solid alkaline material is added to the liquid dispersion after the addition of the alkali metal salt of nitrilotriacetic acid.

6. The process of claim 1 wherein the solid alkaline material is sodium hydroxide in the form of pellets.

7. The process of claim 1 further comprising the step of:

adding a nonionic surfactant to the aqueous alkaline solution before addition of the solid alkaline material.

8. The process of claim 7 wherein the nonionic surfactant is added in an amount between about 0.025 part and about 0.10 part by weight nonionic surfactant to about one part alkaline solution.

9. The process of claim 7 wherein the surfactant is added in an amount capable of yielding a cast detergent containing between about 1.0 and about 4.0 percent by weight surfactant.

10. The process of claim 1 further comprising the step of:

adding an effective amount of an anti-spotting, scale reducing polymeric compound to the aqueous solution prior to the addition of solid alkaline material, the polymer selected from the group consisting of alkali metal salts of polyacrylic acids, copolymers of methyl vinyl ether and maleic anhydride, copolymers of short chain alkenes and maleic anhydride, copolymers of styrene and maleic anhydride, copolymers of maleic acid and acrylic acid and mixtures thereof.

11. The process of claim 10 wherein the polymeric compound is added in an amount less than about 0.125 part by weight polymeric compound to about one part alkaline solution.

12. The process of claim 10 wherein the polymeric compound is employed in an amount capable of yielding a cast detergent containing between about 1.0 and about 2.0 percent by weight of the polymeric compound.

13. The process of claim 10 wherein the polymeric compound is an alkali metal salt of polyacrylic acid.

14. The process of claim 1 further comprising the step of:

adding about 0.025 and 0.1 part nonionic surfactant to about 1 part alkaline solution prior to addition of the solid alkaline material; and adding less than about 0.125 part by weight of a polymeric compound selected from the group consisting of alkali metal salts of polyacrylic acids per 1 part the aqueous alkaline solution prior to addition of the solid alkaline material.

* * * * *